United States Patent [19]

Cobbe, Jr.

[11] 4,031,784

[45] June 28, 1977

[54] DEVICE FOR UNLOCKING FROZEN VALVES

[76] Inventor: George H. Cobbe, Jr., 3411 S. Camino Seco No. 46, Tucson, Ariz. 85730

[22] Filed: Mar. 8, 1976

[21] Appl. No.: 664,899

[52] U.S. Cl. ..... 81/57.39

[51] Int. Cl.[2] ..... B25B 13/04; B25B 13/50

[58] Field of Search ..... 81/3 R, 53 R, 55, 13, 81/314, 74, 75, 60, 90 R, 90 C, 90 D, 57.39; 29/213 E, 213 R; 251/131

[56] References Cited

UNITED STATES PATENTS

| | | | |
|---|---|---|---|
| 1,509,258 | 9/1924 | Reiser | 81/55 |
| 1,880,615 | 10/1932 | White et al. | 29/213 |
| 2,014,718 | 9/1935 | Carington | 81/55 |

*Primary Examiner*—James L. Jones, Jr.
*Assistant Examiner*—Roscoe V. Parker
*Attorney, Agent, or Firm*—Cahill, Sutton & Thomas

[57] ABSTRACT

A first lever engages a first collar rotationally immobile about the body of a valve. A second lever interconnects the first collar with a second collar, which second collar is non-rotatably mounted upon the stem of the valve. Manual vertical manipulation of the levers toward one another is translated through the first and second levers and collars to apply a torque force upon the stem with respect to the valve body to open the valve.

10 Claims, 6 Drawing Figures

DEVICE FOR UNLOCKING FROZEN VALVES

The present invention relates to valve opening mechanisms and, more particularly, to valve opening devices which preclude application of forces to a valve stem or valve body other than about the longitudinal axis of the stem.

Most valves will, at some time or another if not periodically actuated, become locked in the closed position because of dissipation of an attendant lubricant or because of corrosion. Where the fluid regulated by the vlave is of a corrosive type, locking or freezing of the valve may occur relatively rapidly despite periodic actuation of the valve.

Generally, locked, frozen or stuck valves are opened by clamping the valve stem within a wrench, a pir of pliers or similar clamping tool and applying a force upon the handle of the tool. Often, the applied force consists of striking the handle with a sharp blow, such as by the heel of an operator's hand or with a hammer. These applied forces are not only translated into a torque force upon the stem with respect to the valve body but also include a component of force tending to laterally bend or displace the valve stem with respect to the valve body or the valve body with respect to the attached collar. If the magnitude of the bending force is substantial or of a short duration high impact force, the valve stem or valve body may become fully or partially severed. Should this occur with high pressure containers or wherein the fluid contained within the containers is flammable or otherwise place an operators's health and safety in jeopardy, disastrous results may ensue.

The problem presented above is by no means new and has been recognized for somme time. However, the solutions developed to date are either limited to very specific types of valve mechanisms, form an integral part of the valve itself or do not overcome the fundamental problem of applying a torquing force while inhibiting application of any bending forces. The following U.S. patents are representative of the presently known prior art: Nos. D172,632, 1,880,615, 2,402,477, 2,641,052, 3,065,527, 3,248,786, 3,468,198 and 3,744,480.

It is therefore a primary object of the present invention to provide a valve unlocking device which applies only a torquing force upon a valve stem.

Another object of the present invention is to provide a readily transportable valve unlocking device which is easily engageable and disengageable from about a valve body.

Yet another object of the present invention is to provide a manually manipulated tool for unlocking frozen valves.

Still another object of the present invention is to provide a valve unlocking device which translates lever movement into a torque force acting upon the valve stem of a valve.

A further object of the present invention is to provide a valve unlocking device wherein all forces and counterforces are exerted only upon the valve itself.

A still further object of the present invention is to provide a valve unlocking device particularly adapted for standardized valves used in conjunction with chlorine containers.

A yet further object of the present invention is to provide a valve unlocking device which is specifically employable in conjunction with standardized chlorine container valves employing a yoke to retain the outlet pipe in fluid communication with the valve.

These and other objects of the present invention will become apparent to those skilled in the art as the description thereof proceeds.

The present invention may be described with greater specificity and clarity with reference to the accompanying drawings, in which.

Figure 1:
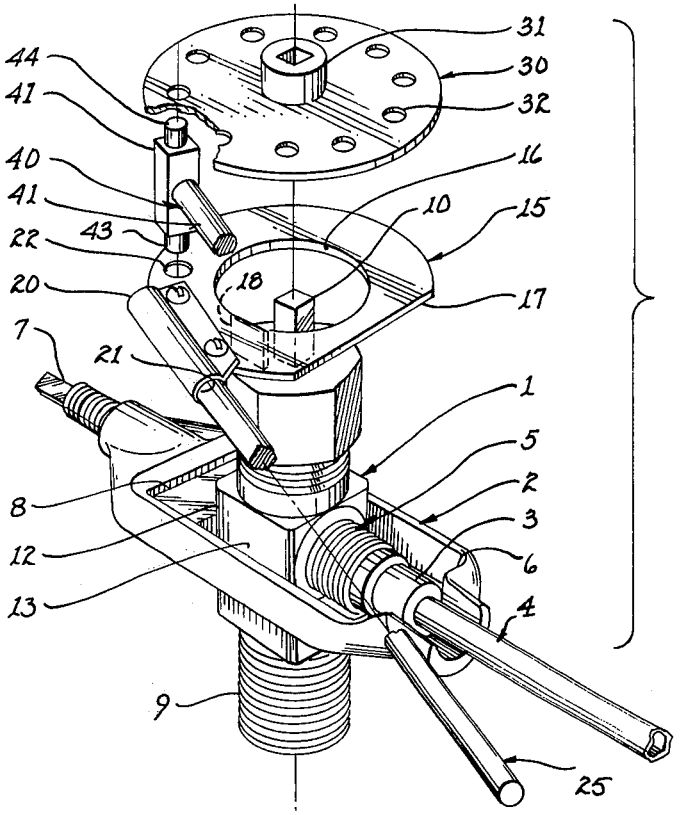
FIG. 1 is an isometric view of the present invention mounted upon a valve body.

FIG. 1 illustrates a valve 1 which may be of any general type although the embodiment illustrated is of a valve standardized by the Chlorine Institute for use in conjunction with chlorine containers. A yoke 2 is employed to secure fitting 3 of outlet pipe 4 to a threaded outlet stud 5 of the valve. Shoulder 6 of the yoke bears against fitting 3 to retain the latter in place by drawing the yoke shoulder toward the valve through manipulation of threaded shaft 7 acting upon plate 8 with the latter bearing against the body of the valve. Threaded valve inlet 9 of the valve is in threaded engagement with the outlet of a container (not shown) such that the fluid within the container is conveyed into the inlet, through the valve seat internal to the valve and expelled through outlet pipe 4. The opening and closing of valve 1 is controlled by counterclockwise or clockwise, respectively, rotation of a valve stem 10.

Figure 2:
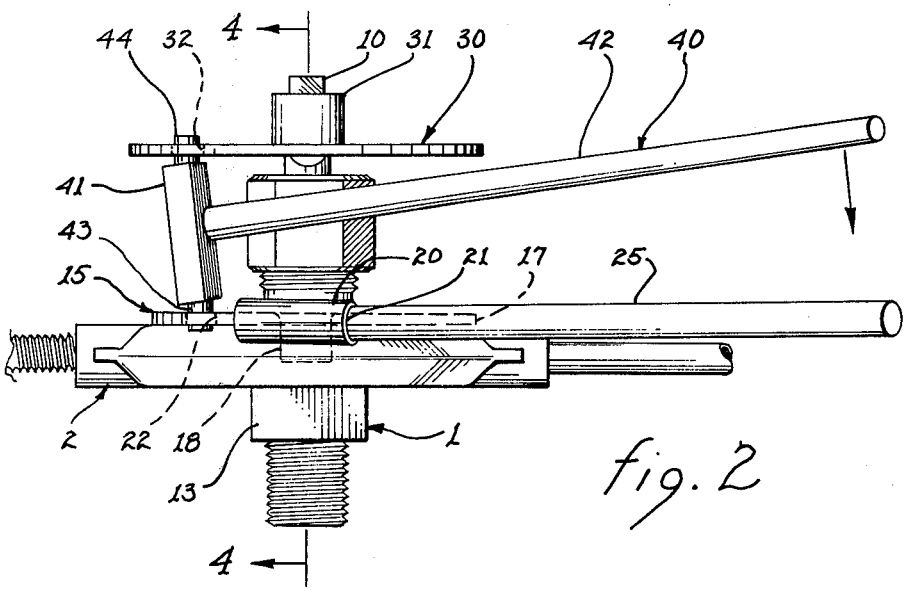
FIG. 2 is a side view of the present invention positioned upon a valve body.
Figure 4:
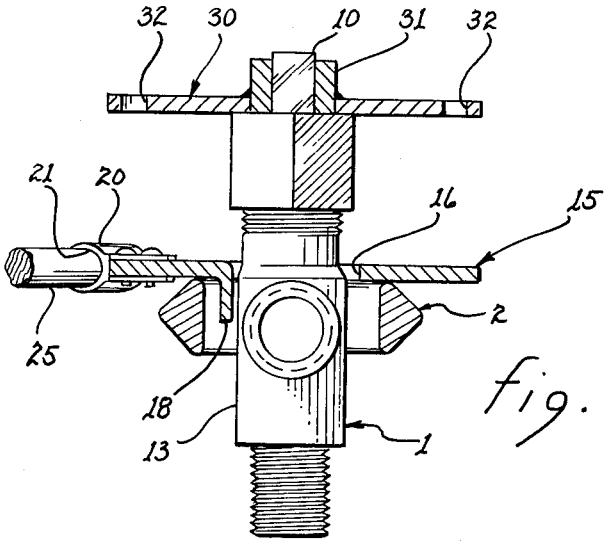
FIG. 4 is a partial cross-sectional view taken along lines 4—4, as shown in FIG. 2.

Referring jointly to FIGS. 1, 2 and 4, a first collar 15 includes a centralized aperture 16 through which the upper end of valve 1 is passed until the collar rests upon the upper edge of yoke 2. A downwardly directed flange 18 extends from the edge of aperture 16 to engage faces 13 of valve 1 and is located intermediate the adjacent leg of the yoke. The flange prevents rotation of the collar about the valve. A straight edge 17 of the collar is adapted to bear against a chlorine regulator when the latter is attached to a Chlorine Institute valve and the interference created thereby aids in inhibiting rotation of the collar.

A member 20 is attached to collar 15 and includes an open ended cavity 21 for receiving one end of lever 25. A further aperture 22 is disposed within collar 15 in proximity to the terminal end of cavity 21.

A second collar 30 includes a centrally located boss 31, which boss, on engagement with stem 10, supports the collar upon the stem. A plurality of apertures 32 are disposed in proximity to the periphery of collar 30. The number of these apertures and their spacing is selected such that on reorientation of collar 30 about stem 10, the angular orientation of the set of apertures with respect to the valve body is altered. Nominally, 10 apertures, as illustrated, may be employed.

Figure 3:
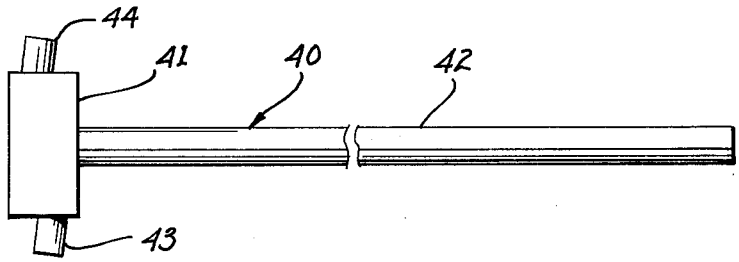
FIG. 3 is a side view of one of the actuating levers of the present invention.

The description of lever 40 will be conducted with joint reference to FIGS. 1 and 3. A head 41 is attached to one end of handle 42. Each of a pair of studs 43 and 44 extend from opposed surfaces of head 41 with the longitudinal axis thereof being parallel to one another and non-perpendicular to the longitudinal axis of handle 42. To aid in maintaining contact intermediate collars 15 and 30 by head 41, the head may be magnetized to attract magnetically the two collars.

The operation of the unlocking mechanism will be described with primary reference to FIG. 2. Collar 15 is mounted upon valve 1 and oriented such that flange 18 is disposed intermediate face 13 of body 12 and the adjacent leg of the yoke. Lever 25, if not permanently attached to collar 15, is inserted within cavity 21 to extend tangentially from the collar. Collar 30 is mounted upon valve stem 10 and oriented such that boss 31 engages the valve stem. Head 41 of lever 40 is positioned intermediate the two collars with stud 43 penetratingly engaging aperture 22. Stud 44 is placed into engagement with one of apertures 32 within collar 30 to position handle 442 in general alignment with lever 25 but angled upwardly therefrom. To achieve this result, it may be necessary to remove and reposition collar 30 until one of apertures 32 provides the desired orientation of handle 42.

By manually squeezing handle 42 toward lever 25, the studs extending from head 41 exert a torque or rotational force upon the respective collars. This force is translated through the collars to induce rotation of valve stem 10 with respect to the valve body. Because of the mechanical advantage affored by the levers, substantial torque forces can be exerted upon the valve stem to unlock or free a frozen valve. In the event handle 42 and lever 25 must be repetitively forced toward one another to effect sufficient rotation of the valve stem to free it, repetitive repositioning of collar 30 to permit insertion of stud 43 into a different one of apertures 32 may have to be performed. The angular orientation of studs 43 and 44 with respect to handle 42 tend to preclude inadvertent disengagement of the respective collars during manipulation of the levers.

It may be well to point out that through the above described operation, only torque forces are aplied intermediate the valve stem and the valve body and no bending moments are applied to the valve stem with respect to the valve body or with respect to the container to which the valve body is attached. Hence, the possibility of accidentally disengaging the valve stem from the valve body, breaking the seal intermediate the valve body and the attached container, or even of partial or total disengagement of the valve body from the container is completely avoided.

Figure 5:
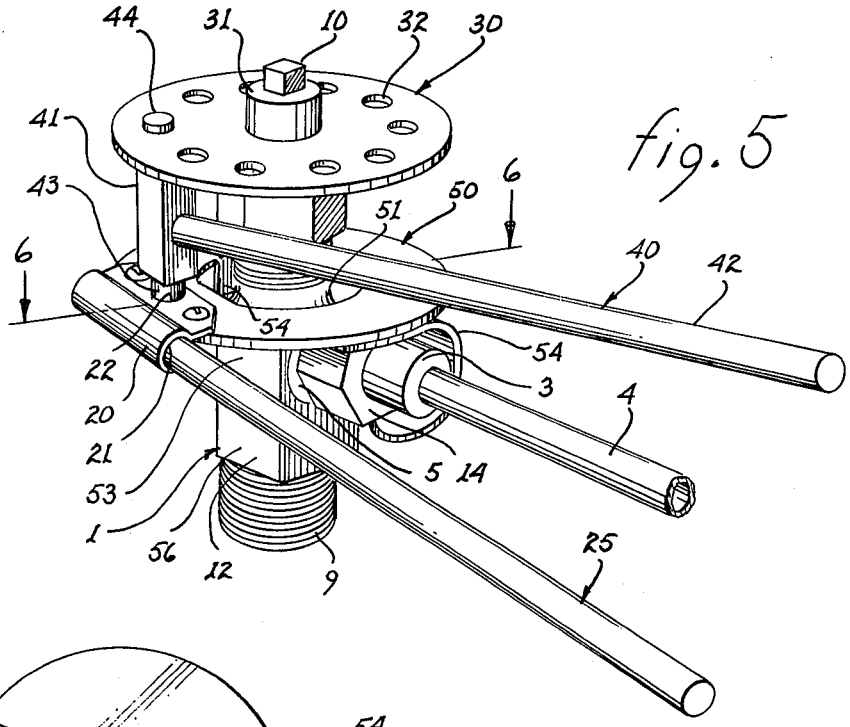
FIG. 5 is a perspective view of a variant of the present invention mounted upon a valve body.
Figure 6:
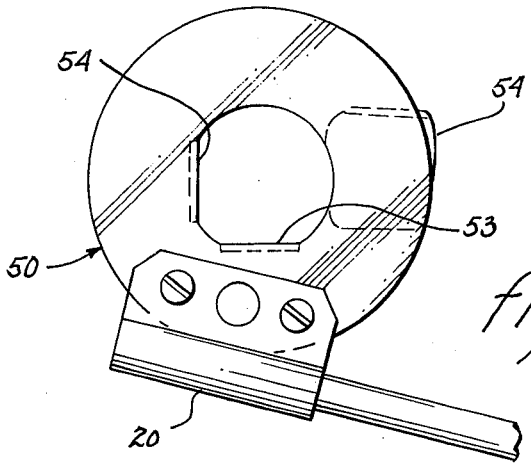
FIG. 6 is a top view taken along lines 6—6, as shown in FIG. 5.

Referring now to FIG. 5 and 6, a variant of the present invention for use in conjunction with valves not employing a yoke will be described. Again, for illustrative purposes only, a valve 1 complying with a chlorine dispensing valve standarized by the Chlorine Institute is depicted. Herein, fitting 3 of outlet pipe 4 is attached to stud 5, which stud represents the valve outlet, by a retaining nut 14. An apertured collar 50 is positioned to rest upon nut 14 by inserting the upper end of the valve body through aperture 51. Flanges 53 and 54, depending downwardly from aperture 51, engage respective faces (of which face 56 is shown) of body 12. A retaining member 59 is attached to the lower surface of collar 50 and curls downwardly to partially engage the periphery of nut 14. Member 20 is secured to collar 50 and includes a cavity 21 for receiving lever 25. An aperture 22 is disposed within collar 50 in proximity to member 20. Lever 40, as illustrated in FIG. 5, is similar to the lever illustrated in FIG. 3. Collar 30 and the elements thereof are similar to that described above.

In operation, collar 50 is dropped onto or otherwise placed into engagement with valve 1 and rotated about its vertical axis until retaining member 59 comes into engagement with nut 14. Simultaneously, flanges 53 and 54 become positioned adjacent corresponding faces of valve body 12. The combination of retaining member 59 and flanges 53 and 54 essentially preclude rotation of collar 50 about the vertical axis in a clockwise direction. Lever 25, if not already positioned within cavity 21, is placed therein. Collar 30 is mounted onto valve 1 by engaging the aperture of boss 31 with valve stem 10. Concurrently, studs 44 and 43 of lever 40 are penetratingly inserted within one of apertures 32 and aperture 22, respectively. Again, reorientation of collar 30 may be necessary in order to position lever 40 in general vertical alignment with but angularly displaced from lever 25, as described above.

By squeezing or otherwise forcing levers 25 and 40 vertically toward one another, a clockwise force is exerted upon collar 50 by stud 43 and a counterclockwise force is asserted upon collar 30 by stud 44. As collar 50 is constrained from movement by the combined action of retaining member 59 and flanges 53 and 54, the forces exerted will tend to force counterclockwise rotation of collar 30. The resulting rotation of collar 30 will be translated therethrough to valve stem 10 and result in breaking or freeing the valve from its locked or frozen state.

Because of the mechanical advantage created by lever 40, the angular rotation of collar 30 is very small with respect to the vertical repositioning of lever 40. Hence, stud 44 may have to be repetitively repositioned within several of apertures 32 in order to cause sufficient rotation of valve stem 10 to completely free the valve.

As described above, apertures 32 within collar 30 are positioned in proximity to the periphery of the collar such that any quadrant of the collar includes a different number and/or radially oriented apertures than any other quadrant. By reorientating collar 30 about the valve stem at least one of apertures 32 will become positioned to receive stud 44 and position handle 42 in proper angular orientation with respect to lever 25.

As described above with respect to the embodiment illustrated in FIGS. 1 and 2, the variant shown in FIG. 5 applys only a torque force upon valve stem 10, which torque force is resisted only by the body of the valve. Hence, no bending moments are imposed upon valve stem with respect to the valve body or upon the valve body with respect to the attached container.

While the principles of the invention have now been made clear in an illustrative embodiment, there will be immediately obvious to those skilled in the art many modifications of structure, arrangement, proportions, elements, materials, components, used in the practice of the invention which are particularly adapted for specific environments and operating requirements without departing from those principles.

I claim:

1. A tool for freeing locked and frozen valves which applies only torque forces about the longitudinal axis of the valve intermediate the valve stem and the valve body, said tool comprising in combination:

a. a first apertured collar for circumscribingly engaging the valve body, said collar including restraining means for inhibiting rotation of said first collar about the longitudinal axis of the valve body;

b. a first lever extending generally tangentially from said first collar;

c. an aperture disposed in said first collar in proximity to the point of attachment of said first lever;

d. a second collar for non-rotatably engaging the valve stem, said second collar including a plurality of apertures spaced about the periphery of said second collar; and e. a second lever positionable in general vertical alignment with said first lever for inducing relative rotational movement between said first and said second collars, said second lever including a first stud for engaging said aperture within said first collar and a second stud for engaging one of said plurality of apertures within said second collar;

whereby, on urging angular displacement of said second lever toward said first lever, said first and second studs generate only a torque force acting through said first and second collars upon the valve body and valve stem, respectively, to unlock and unfreeze the valve stem.

2. A tool for freeing locked and frozen valves which applies only torque forces intermediate the valve stem and the valve body about the longitudinal axis of the valve, said tool comprising in combination:

a. first collar means for engaging the valve body, said first collar means including aperture means disposed therein and means for constraining rotational movement of said first collar means about the valve body;

b. second collar means for non-rotatably engaging the valve stem, said second collar means including at least one further aperture means;

c. lever means for engaging said aperture means within said first collar means and one of said further aperture means within said second collar means; and d. said lever means comprising a handle, a head, a first stud extending from one end of said head for engagement with said aperture means of said first collar and a second stud extending from another end of said head for engagement with one of said further aperture means with said second collar;

whereby, angular displacement of said lever means results in a translation of forces to produce relative rotation of said first collar means with respect to said second collar means about the longitiudinal axis of the valve stem and application of only a torque force intermediate the valve body and the valve stem.

3. A tool for freeing locked and frozen valves which applies only torque forces intermediate the valve stem and the valve body about the longitudinal axis of the valve, said tool comprising in combination:

a. first collar means for engaging the valve body, said first collar means including aperture means disposed therein and means for constraining rotational movement of said first collar means about the valve body;

b. second collar means for non-rotatably engaging the valve stem, said second collar means including at least one further aperture means;

c. lever means for engaging said aperture means within said first collar means and one of said further aperture means within said second collar means; and d. further lever means extending from said first collar means, said further lever means being oriented in general planar alignment with said lever means;

whereby, a force exerted upon both said lever means and said further lever means angularly displaces and draws said lever means towards said first further lever means and results in a translation of forces to produce relative rotation of said first collar means with respect to said second collar means about the longitudinal axis of the valve stem and application of only a torque force intermediate the valve body the the valve stem.

4. The tool as set forth in claim 3 wherein said first collar means comprises an apertured first collar for receiving the valve body.

5. The tool as set forth in claim 4 wherein said second collar means comprises a second collar having an apertured boss for receiving the valve stem.

6. The tool as set forth in claim 5 wherein said aperture means comprises an aperture disposed within said first collar.

7. The tool as set forth in claim 6 wherein said further aperture means comprises a plurality of apertures located in proximity to the periphery of said second collar, said plurality of apertures being non-uniformly displaced within each quadrant of said second collar.

8. The tool as set forth in claim 7 wherein said constraining means comprises flange means located in proximity to adjacent faces of the valve body to prevent rotation of said first collar about the longitudinal axis of the valve body.

9. The tool as set forth in claim 7 wherein said lever means comprises a handle, a head, a first stud extending from one end to said head for engagement with said aperture of said first collar and a second stub extending from another end of said head for engagement with one of said further apertures within said second collar.

10. The tool as set forth in claim 9 where the longitudinal axis of said first and second studs are aligned parallel to one another and non-perpendicular to the longitudinal axis of said handle.

* * * * *